US007275329B2

(12) United States Patent
Rager

(10) Patent No.: US 7,275,329 B2
(45) **Date of Patent: *Oct. 2, 2007**

(54) BOW SIGHT WITH INJECTION MOLDED METAL SIGHT PINS, AND METHODS

(75) Inventor: Christopher A. Rager, Bozeman, MT (US)

(73) Assignee: Bear Archery, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/502,607

(22) Filed: Aug. 10, 2006

(65) Prior Publication Data

US 2007/0113411 A1 May 24, 2007

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS 5,791,060 A * 8/1998 Godsey ..... 33/265
6,290,903 B1 * 9/2001 Grace et al. ..... 419/28
7,103,981 B1 * 9/2006 Rager ..... 33/265

* cited by examiner

*Primary Examiner*—Christopher W Fulton
(74) *Attorney, Agent, or Firm*—Woodard, Emhardt, Moriarty, McNett & Henry LLP

(57) ABSTRACT

The invention relates to an archery device having a part or component is injection molded; the part is injection molded metal, ceramic, or composite material. A sight pin for a bow sight is a part that is especially suited for being injection mold. Injection molding of metal, ceramic or composite sight pins allows for various cross-sectional shapes and areas for the pin along its length. The injection molded sight pin can be a vertically extending pin or a horizontally positioned pin, and multiple pins may be configured for viewing in a straight line.

16 Claims, 4 Drawing Sheets

BOW SIGHT WITH INJECTION MOLDED METAL SIGHT PINS, AND METHODS

CROSS REFERENCE TO RELATED APPLICATIONS

This application claims priority under 35 U.S.C. § 119(e) to utility application Ser. No. 10/997,366 filed Nov. 24, 2004, now U.S. Pat. No. 7,103,981, and to provisional application Ser. No. 60/526,399, filed Dec. 1, 2003. The complete disclosures of application Ser. Nos. 10/997,366 and 60/526,399 are incorporated by reference herein.

FIELD

The invention relates to bow sights and methods of making. More specifically, the invention is directed to methods of making bow sight parts, such as pins for holding sight points, using metal injection molding processes.

BACKGROUND

Many bow sight designs and configurations are known. Bow sights generally have multiple sight points used when shooting at targets positioned at different distances from the archer.

A common sight point is a two-dimensional dot, such as painted on the end of a pin. The end of a fiber optic or other light gathering fiber is another common sight point. When a fiber end is used as the sight point, the fiber optic may or may not be supported, for example by a pin.

Many bow sights include multiple sight points attached to horizontal pins; examples of such bow sights are shown, for example, in U.S. Pat. Nos. 5,103,568 (Canoy); 5,676,122 (Wiseby et al.); and 5,685,081 (Winegar). A more recent development has been a bow sight with vertical pins. An example of a bow sight having multiple vertical pins and a fiber optic sight point at the end of the pins is shown, for example, in U.S. Pat. No. 6,418,633 (Rager). A number of U.S. patents disclose bow sights having various other arrangements of sight points. See, for example, U.S. Pat. Nos. 3,234,651 (Rivers); 4,120,096 (Keller); 5,086,567 (Tutsch); and 5,131,153 (Seales).

The pins, which are sufficiently rigid and strong to support the sight points, are usually either plastic or metal. Plastic has generally been preferred due its ease of processability; pins of various shapes and sizes can be easily produced, such as by extrusion or molding. Metal pins are preferable due to their strength, however, it has generally been difficult to produce acceptable pins, as the metal is generally machined or cast to form the pin structure.

Improvements in bow sights and their parts, particularly in the pins, are desired.

SUMMARY

One aspect of the disclosure is directed to a bow sight having part made from a injection molded material, the material being metal, ceramic, or a composite. In a preferred embodiment, the part is a sight pin made of an injection molded material. The sight pin may support a sight point, such as an end of a fiber optic cable, a painted dot, or any other structure having relatively high visibility.

Yet another particular aspect of the disclosure relates to a method of making a part for a bow sight, such as a sight pin for a bow sight. The method includes the following steps: providing a mold being an inverse of a desired part structure; injection molding powdered material such as metal, ceramic, or ceramic into the mold; and removing a part from the mold. In one preferred embodiment, the part is a sight pin.

BRIEF DESCRIPTION OF THE DRAWINGS

The accompanying drawings, which are incorporated in and constitute a part of the description, illustrate examples of several inventive features and together with the detailed description, serve to explain the principles of the disclosure. A brief description of the drawings is as follows.

DETAILED DESCRIPTION

In the following description, reference is made to the accompanying drawings, to show by way of illustration example embodiments in which the invention may be practiced. It is to be understood that other embodiments may be utilized and structural changes may be made without departing from the scope of the present invention.

A bow sight is a device that is attached to an archery bow and provides one or more sight points which the archer uses to aim at the target. The sight is typically attached to the riser of the bow. A peep sight may be placed on the string of the bow such that the archer can sight through the peep sight and see the sight point with the target in the background. For purposes of this application, the view of the bow sight as seen by the archer in the shooting position is referred as the front view or front side of the bow sight.

The Bow Sight

Figure 1:
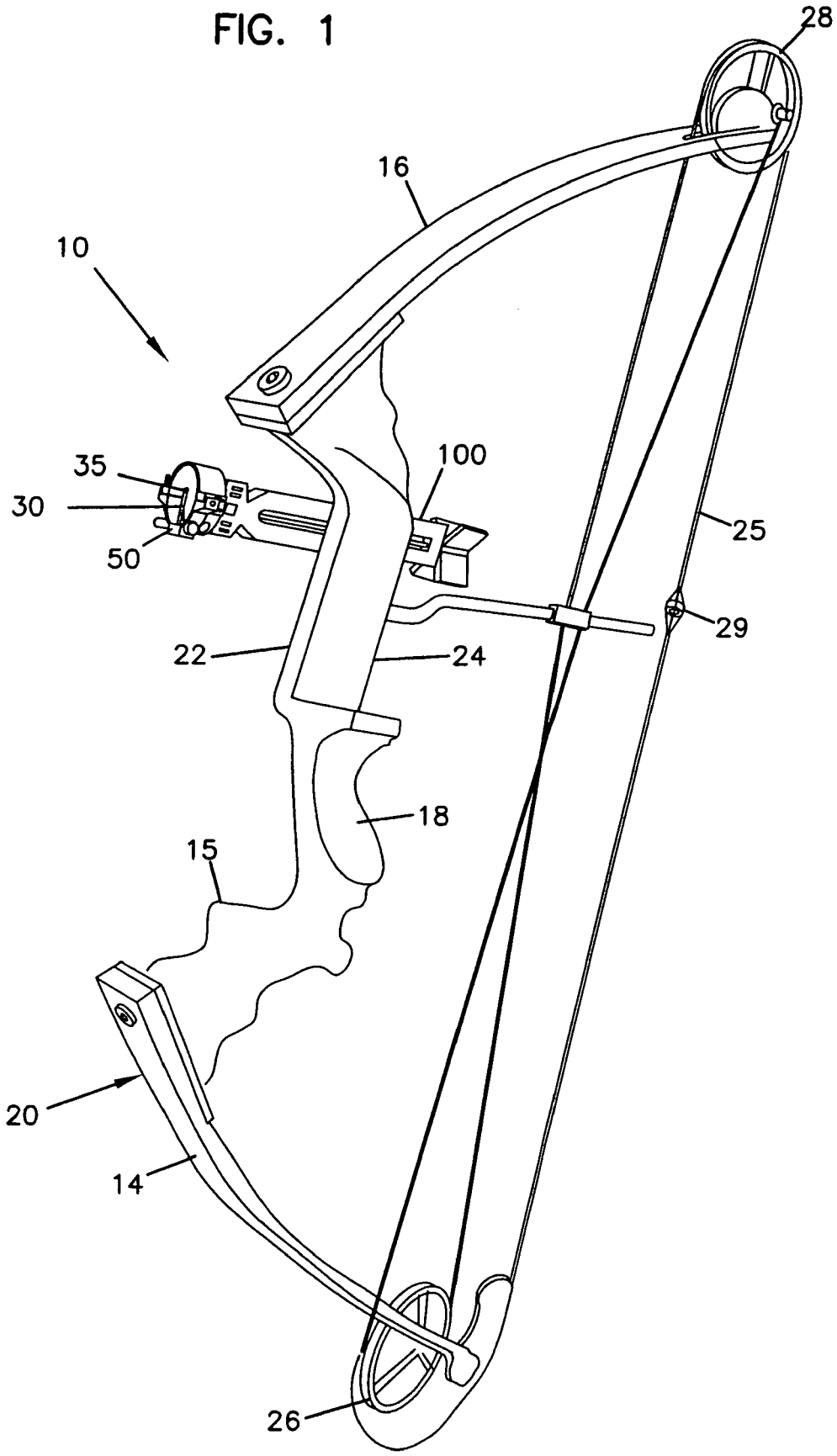
FIG. 1 is a perspective view of a bow incorporating a bow sight having features that are examples of inventive aspects in accordance with the principles of the present disclosure.

Referring now to the figures, wherein like features are referenced with like numerals, a bow 10 is shown in FIG. 1. Bow 10 includes a frame 20 having a lower portion or arm 14, an upper portion or arm 16, and a handle portion 15 with a grip 18 connected to and supporting lower arm 14 and upper arm 16. Bow 10 has a front surface 22 and an opposite back surface 24. During shooting with the bow, front surface 22 of bow 10 is positioned facing the target and back surface 24 of bow 10 is facing the archer.

Bow 10 includes a string 25 connected to lower arm 14 and upper arm 16. String 25 provides the propulsion of the arrow shot from bow 10. Bow 10 is illustrated as a compound bow, with pulley or cam 26 at the end of lower arm 14 and pulley or cam 28 at the end of upper arm 16.

Bowstring 25 extends between cam 26 and cam 28. Cams 26, 28 provide a mechanical advantage to the archer when drawing bowstring 25. A peep sight 29 is often positioned on bowstring 25 to facilitate targeting and aiming.

Mounted on handle portion 15 of bow 10 is a bow sight 50. Bow sight 50 includes a sight pin 30 supporting a sight point 35, which, in this embodiment is defined by the end of a light gathering member such as an optical fiber. Additional details regarding sight point 30 and sight point 35 are provided below. In the embodiment illustrated in FIG. 1, bow 10 includes a vertical positioning mechanism 100 connected to handle 15 and bow sight 50 for vertically adjusting the elevation of bow sight 50 and its corresponding sight point 35 relative to bow 10.

Figure 2:
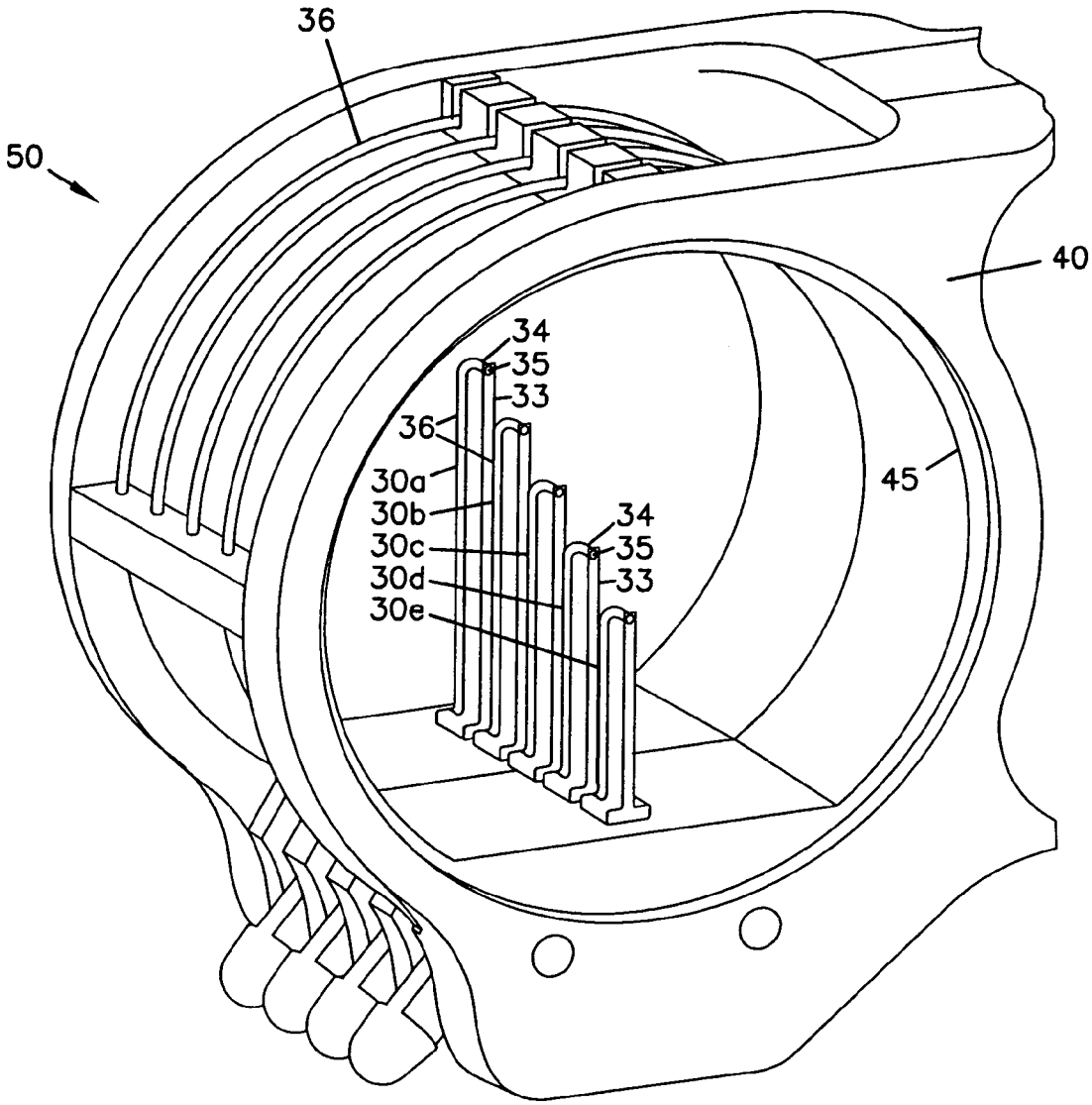
FIG. 2 is a perspective view of the bow sight of FIG. 1 in isolation from the bow.

Referring to FIG. 2, a bow sight 50 is illustrated. Bow sight 50 includes a body 40 defining a viewing opening or window 45 and at least one sight pin 30 having sight point 35 positioned within window 45. Window 45 may be referred to as a field of view of bow sight 50. Body 40 can include one or more members. In certain embodiments, body 40 forms a housing that defines window 45 and also shields and/or guards the at least one sight pin 30 within the housing.

Body 40 is a structure that provides an attachment structure for sight pin 30. Additionally body 40 forms a protective support for sight pins 30, at least partially surrounding pin 30, thus reducing the opportunity for pin 30 to be bent or otherwise damaged. Body 40 is attached to handle portion 15 of bow 10, either directly or indirectly. That is, body 40 may be directly mounted onto bow 10. In the embodiment illustrated in FIG. 1, body 40 is connected to vertical positioning mechanism 100, which is mounted onto bow 10.

Pins of the Bow Sight

As stated, bow sight 50 includes a pin 30, and in a preferred embodiment, sight 50 has a plurality of pins 30 specifically indicated as pins 30*a*, 30*b*, 30*c*, 30*d*, and 30*e*, but herein after referred to generally as "30".

Each pin 30 has a generally elongate portion 33 extending between a first end and a second end. In this particular embodiment of FIG. 2, pins 30 are vertical pins, meaning, that first end 32 and second end 34 are generally aligned along a vertical plane. First end 32, connecting pin 30 to body 40, is also referred to as a proximal end or an attachment end, and, second end 34 opposite attachment end 32 is also referred to as a distal end or a sighting end. Second or tip end 34 supports sight point 35, as will be described below.

Referring again to FIG. 2, each of pins 30 is supported by and preferably movably attached to body 40 at its attachment end 32.

In the embodiment illustrated in FIG. 2, pins 30 are vertical pins; that is, elongated portion 33 extends from end 32 to end 34 in a generally vertical orientation, when viewed by the archer in a shooting position. The embodiment of FIG. 2 has the elongate portion 33 being a generally straight portion. Other configurations of elongate portion 33 and pin 30 can be used. For example, a pin could be L-shaped with a vertical portion and a horizontal portion of the L-shape pin extending in the direction toward the archer in the shooting position. If the horizontal portion of an L-shaped pin extends toward the archer, from the archer's view, it will appear that second end 34 of an L-shaped pin is oriented generally vertically above first end 32. Alternate embodiments are illustrated in FIGS. 3 and 4.

Figure 3:
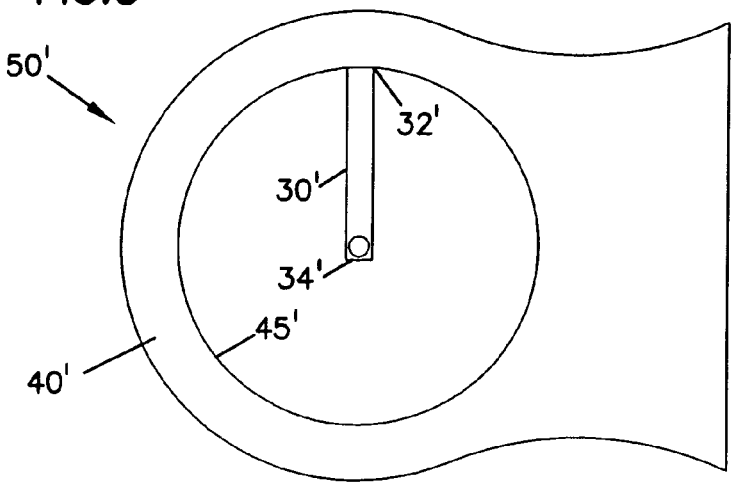
FIG. 3 is a perspective view of an alternative embodiment of the bow sight according to the principles of the present invention.

FIG. 3 illustrates a bow sight 50' having a vertical pin, but with the attachment end vertically oriented above the sighting end. In particular, bow sight 50' has a pin 30' with a first end 32' and a second end 34'. Pin 30' is positioned within body 40', particularly, within window 45'. Pin 30' is attached to body 40' at first end 32'.

Figure 4:
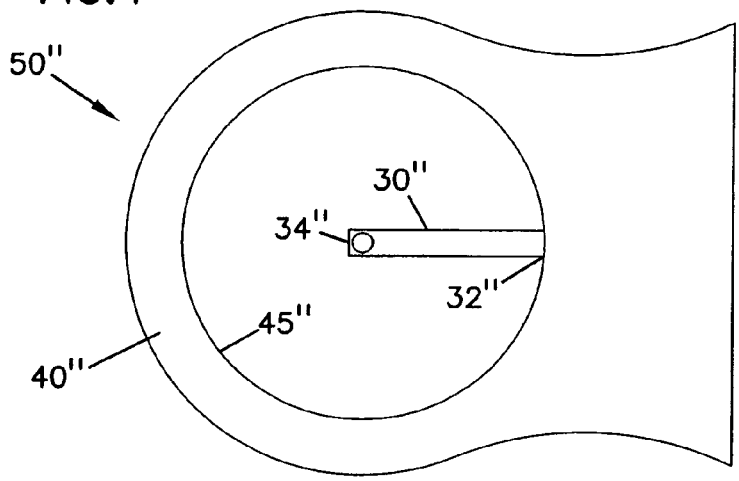
FIG. 4 is a perspective view of a further embodiment of a bow sight according to the principles of the present invention.

FIG. 4 illustrates a bow sight 50" having a non-vertical pin, specifically, a horizontal pin, with neither the attachment end nor the sighting end vertically oriented above the other. In particular, bow sight 50" has a pin 30" with a first end 32" and a second end 34". Pin 30" is positioned within body 40", particularly, within window 45". Pin 30" is attached to body 40" at first end 32".

Figure 5A:
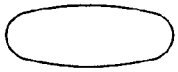
FIGS. 5*a* through 5*g* are various transverse cross-sectional views of example pins according to the principles of the present invention.
Figure 5B:
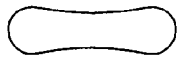
Figure 5C:
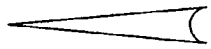
Figure 5D:
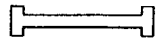
Figure 5E:
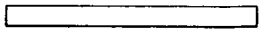
Figure 5F:
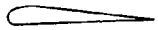
Figure 5G:
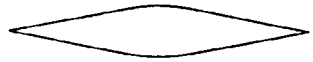

In certain embodiments, the cross-sectional shape of the pin, taken at a right angle to the length of elongate portion 33, at least at first or attachment end 32, is not circular. Examples of non-circular shapes include obround and angular shapes. Examples of obround shapes include oval, elliptical, and other non-circular shapes that do not have sharp or angled corners, for example a racetrack shape which resembles a rectangle with rounded corner. Angular shapes are those that include an angle. Angular cross-sections include, but are not limited to, named polygonal shapes such as triangles, rectangles and squares, pentagons, hexagons, and octagons, and many unnamed shapes. Various non-circular shapes, suitable as a cross-sectional shape for pin 30, are shown in FIGS. 5A through 5G. FIGS. 5A and 5B provide two examples of obround non-circular shapes. FIGS. 5C through 5G provide five examples of angular shapes. Pins 30 having circular cross-sections are also within the scope of the present invention.

Angular shapes typically have at least one flat or planar side or surface. Each of the five angular shapes illustrated defines at least one flat or planar surface. Obround shapes may or may not have at least one flat or planar side; for example, a racetrack shape has four flat surfaces, whereas an oval has none. Preferably, although not required, pin 30 has at least one flat or planar surface proximate first end 32; such a flat or planar surface facilitates the attachment of pin 30 to body 40.

The cross-sectional shape and area of the pin need not be consistent along elongated portion 33 or the length of pin 30; that is, the cross-sectional shape and area can vary from first end 32 to second end 34. For example, a portion of pin 30 proximate second end 34 may be circular whereas a portion of the same pin 30 proximate first end 32 may be square. As stated above, proximate first end 32 is preferably a flat or planar portion. Second end 34 may be any of circular, obround, angular, or the like.

Second end 34 is alternately referred to as sighting end 34 or variations thereof. Second end 34 supports sight point 35.

Sight Point

Sight point 35 can be a shape, a point, an element, or indicia of any sort that is intended to assist in the proper aiming and targeting of the bow. Sight points can, for example, be circular shapes, other geometric shapes, colored dots, painted dots, the end of a light gathering cable, any time of light emitting structure or higher visibility structure, or simply the end of pin 30.

FIG. 2 shows sight point 35 located at end 34 of pin 30 that is opposite attachment end 32. Typically, sight point 35 is at the tip or close to the tip of end 34, although in some embodiments, sight point 35 may be spaced from the tip of end 34.

In a preferred embodiment, a fiber optic cable or a light gathering cable 36 provides sight point 35; in particular, the end of fiber optic cable 36 forms sight point 35. Fiber optic cable 36 is preferred as sight point 35 because cable 36 collects light along its length, and the light exits the end of cable 36, creating an illuminated sight point 35. As the length of fiber optic cable 36 increases, the amount of light collected increases. A preferred embodiment has a length of cable 36 wrapped around a portion of body 40, as illustrated in FIG. 2.

In this preferred embodiment, the end of fiber optic cable 36 is held in place by a hole or aperture in pin 30 proximate end 34. Such a hole or aperture is readily made using the pin manufacturing method of this invention, described in detail below, or, such a hole or aperture is readily made in a subsequent step, such as by boring or drilling. In an alternate embodiment, though not as preferred, fiber optic cable 36 is attached, for example by adhesive, to end 34 of pin 30.

As stated above, the region at which pin 30 is attached to body 40 is at first end 32. It is understood that the attachment is not necessarily at a single point at first end 32, but rather may be an extended area at which pin 30 is attached to body 40. Pin 30 can be attached to body 40 in various orientations or configurations. As stated above, pins 30 illustrated in FIG. 2 are vertical pins, oriented with second end 34 positioned vertically above first end 32. FIG. 3 illustrates pin 30' vertically oriented with first end 32' positioned vertically above second end 34'. FIG. 4 illustrates pin 30" with first end 32" and second end 34" horizontally oriented with respect to one another.

It is often desired to adjust the position of the sight point relative to the bow. These adjustments are made to "sight-in" the bow so that each sight point is accurately associated with a target at a particular distance. A pin is termed "adjustable" when the associated sight point for that pin can be moved relative to the bow. In a preferred embodiment of the invention, the pin is adjustable by movement of the entire pin, generally by an adjustment mechanism. For vertically positioned pins, such as pin 30, pin 30 is vertically adjustable, or, is adjustable in the vertical direction.

Figure 6:
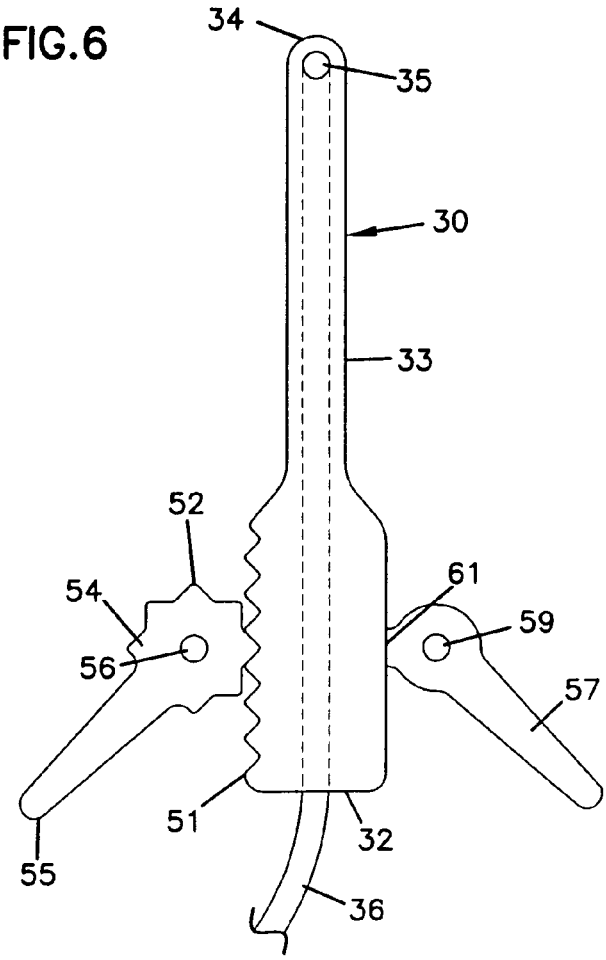
FIG. 6 is an enlarged view of a pin, an associated adjustment knob, and an associated cam member.

Referring to FIG. 6, a preferred mechanism for adjusting pin 30 is illustrated. This design includes a geared interaction between pin 30 and a portion of sight body 40 (not shown). In particular, pin 30 includes toothed or gear surface 51. Positioned on the sight body 40 (not shown in FIG. 6) is adjustment member 54, which includes surface 52. Surface 52 operably interacts with gear surface 51 such that movement of adjustment member 54 results in movement of pin 30. In this particular embodiment, the movement of surface 52 to surface 51 is linear movement in a vertical direction. Adjustment member 54 can include a lever 55 to facilitate movement of surface 52. Lever 55 can be integral with adjustment member 54. An axis rod 56 can be used to attach member 54 to body 40 (not shown) and to provide a pivot point for level 55 and surface 52.

The design includes a cam system to lock pin 30 and inhibit movement between surface 51 and surface 52. A cam member 57 includes a cam portion 61 that rotates about an axis rod 59. Rotation of cam member 57 results in engagement or disengagement of cam portion 61 with pin 30, on the side opposite gear surface 51. This camming action allows the archer to inhibit pin 30 from moving once the position is set.

Figure 7A:
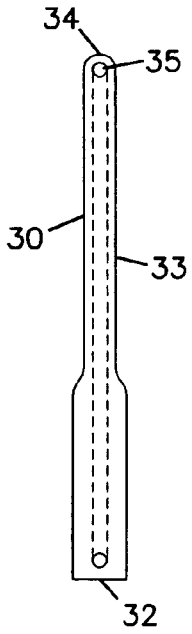
FIG. 7A is a rear view of a pin according to the principles of the present invention.
Figure 7B:
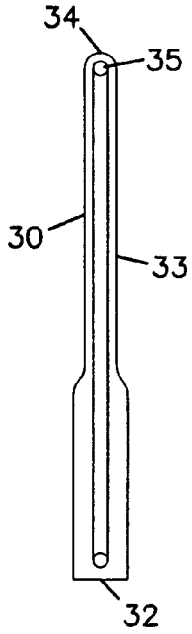
FIG. 7B is front view of a pin according to the principles of the present invention.
Figure 7C:
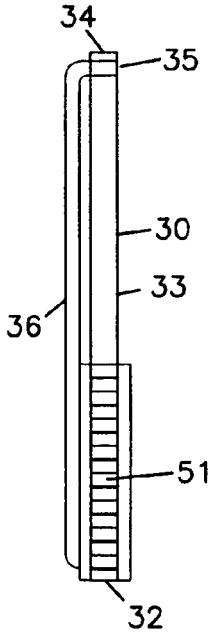
FIG. 7C is a left view of a pin according to the principles of the present invention.
Figure 7D:
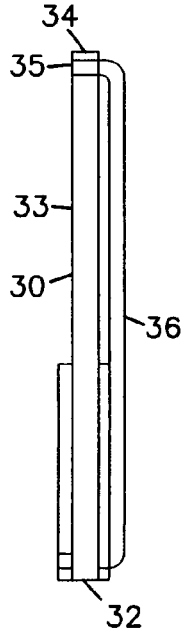
FIG. 7D is a right view of a pin according to the principles of the present invention.

FIGS. 7A through 7D show a preferred embodiment of pin 30, with fiber optic 36, from various views. FIG. 7A is a front view (as seen by the archer in the shooting position); FIG. 7B is a rear view; FIG. 7C is a view of the right side where geared surface 51 is seen, and FIG. 7D is a left side view.

To adjust the position of pin 30, the archer rotates cam member 57 around axis 59 releasing portion 61 from pin 30. Then, the archer adjusts the position of pin 30 by moving adjustment lever 55 so that engaging surfaces 51 and 52 move pin 30 to the desired position. Afterwards, cam member 57 is returned to have portion 61 in engagement against pin 30 to hold pin 30 in the new position.

Other mechanisms and designs for an adjustment mechanism are suitable. For example, a set screw could be used in place of cam members 57. Such set screws (not shown) would typically extend perpendicular to pin 30. Tightening of the screw would secure the position of pin 30. Having a planar or non-curved surface for a set screw to seat against is preferred. To adjust the height of pin 30, the screw would be loosened and adjustment knob 55 rotated. In an alternate embodiment, after being released from the set screw, pin 30 could be manually raised and lowered by hand.

Bow sight 50, with pin 30, may include various other elements that are known, for example from U.S. Pat. No. 6,418,633 (Rager), elements such as a torque adjustment mechanism, a dampener to reduce vibration between sight 50 and bowstring 25, etc.

As discussed above, in one aspect of the present invention, pin 30 has a non-circular cross-sectional shape, at least proximate first end 32 at the attachment to body 40 locus. Preferably, pin 30 has a flat or planar surface at the attachment locus. Having a flat, non-rounded face at the attachment locus, for example, where a set screw would engage pin 30, increases the hold of the set screw on pin 30. A preferred method for making pin 30 is provided below.

Method of Making a Bow Sight Part

A preferred method for making parts for bow sight 50 is by an injection molding powder process. The material injection molded may be metal, ceramic, or composite materials. For ease of understanding, the following description will refer to "metal", "metal injection molding" and the like, but it is to be understood that any of metal, ceramic, or composite materials could be used. Parts that could be formed by the metal injection molding process include housing 40 or any portion thereof, vertical positioning mechanism 100 or any portion thereof, various mounting brackets, and the like. Additionally, arrow rests, such as described in U.S. Pat. No. 6,823,856 (Rager), could include parts that are metal injection molded. Sight pins 30, in particular, are a preferred part to be made by metal injection molding.

In certain embodiments, the injection molding process facilitates making pins having non-circular or angular cross-sectional shapes. A general method for injection molding metal is summarized as follows:

The starting material for metal injection molding is typically small, finely powdered metal particles, such as titanium or high carbon steel. Prior to molding, these fine metal powders are mixed with a polymeric (i.e., organic) binder. The polymeric binders may be liquid or solid when mixed with the metal powder. Alternately, low melting metal based binders may be used rather than the polymeric binders. The metal/binder mixture is pelletized to form an easily handleable feedstock for an injection molding machine.

The pelletized mixture is injected into a mold and optionally compressed to form a green part. The mixture may be solid (i.e., still pelletized) or may be molten (i.e., at least partially melted) immediately prior to being injected into the mold. This green part has a volume approximately 10-20% larger than the end design to account for shrinkage during subsequent processing, but has the precise geometric configuration of the final pin 30.

The polymeric binders are removed from the mixture, generally by a thermal process that burns off the organic material. This step is commonly referred to a "debinding". In some embodiments, prior to debinding, a solvent bath may be used as an initial step.

The powdered metal component is next placed in a sintering furnace and sintered at an elevated temperature and pressure to achieve near full density thereof. The sintering processing parameters are defined such that the pin reaches a density of at least 90%, preferably at least 97%, and most preferably at least 99%. During the sintering process, the overall size of the pin shrinks approximately 10-20%. Once sintering is complete, the pin component has a net shape and does not require further machining.

Ceramic and composite materials may also be suitable for powder injection molding (PIM) of pin 30. Ceramic or composite materials may be substituted for or combined with the powdered metal compositions used above. Examples of suitable ceramic materials include alumina, ziconia, and tungsten carbide materials.

Pin 30 can be molded with various features such as a slot, aperture or other mounting feature for retaining a sight point. If sight point 35 is the end of fiber optic cable 36, pin 30 is preferably molded to include an aperture or hole at end 34 to accept fiber optic 36 therethrough. In addition, geared surface 51 can be molded into pin 30. Those skilled the art will recognize that the shape and size of pin 30 can be any shape that can be molded.

As presently preferred, the pins are manufactured using a powdered metal technology, due to the increased strength and rigidity of metal compared to other materials. However, one skilled in the art will readily recognize that other powdered materials such as ceramics or composites, or any combinations thereof, may be suitable, and thus utilized herein. The determination of the exact materials is dictated by the requirements of a given application.

Any number of various metal materials or compounds can be used for pin 30. For example, low alloy and alloy steels can be used; these have good strength, fatigue resistance, and high surface hardness. Examples of such materials include alloys of 2% nickel-iron (available as "MIM2200"), 7% nickel-iron (available as "MIM2700"), chromium-molybdenum steel ("130"), and nickel-chromium-molybdenum steel ("4340"). Soft magnetic materials can be used. These materials have high permeability and are 'low loss' magnetic alloys. Examples of such alloys include 2% nickel-iron, 50% nickel-iron, 80% nickel-iron, nickel-zinc ferrite alloy, and 3% silicon-iron alloy. Tool steels, which have high hardness and wear resistance, are also suitable. Examples of tool steels include "Micro-Melt M2" alloy and "Micro-Melt M4" alloy. Precipitation hardening stainless steels have high strength, toughness and hardness, with excellent corrosion resistance. Examples of such steels include "15-5 PH" and "17-4 PH" (which is also known as "Custom 630"). Martensitic stainless steels are designed to provide stainless properties with excellent hardness, strength and wear resistance. Examples of such materials include "Type 420", "Type 440C", and "440-XH"® alloy. Ferritic stainless steels have good corrosion resistance, good heat resistance, good machinability and magnetic properties. Examples of such materials are available as "Type 430L". Austentic stainless steels have excellent cryogenic properties, superior corrosion resistance, and good high temperature strength. Examples of such materials are available as "Type 304L" and "Type 316L". These materials listed above are available from various metal injection molding outfits, such as Parmatech, Corp. of Petaluma, Calif. and Remington Arms Company of Ilion, N.Y. Other materials and alloys for injection molding are known and are available.

Using metal injection molding techniques, pin 30, having various features, can be easily and precisely molded. For example, pin 30 with a dimensional tolerance of 0.005 inch is readily moldable. Such precision is desired when pin 30 retains sight point 35 (such as fiber optic cable 26) and/or include gear surface 51, or other such detailed features. Having pin 30 made from metal increases the resistance to wear and tear on pin 30, for example, on gear surface 51 and the surface engaged by cam portion 61 of cam member 57. Additionally, a hard metal surface has better resistance to set screws. Still further, a metal pin is more rigid and resistant to bending.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

What is claimed is:

1. A method of making a part for a bow sight, the method comprising: (a) providing a mold being an inverse of a desired part structure; (b) injection molding powdered metal, ceramic or composite into the mold; and (c) removing from the mold a metal, ceramic or composite part with a dimensional tolerance of 0.005 inch.

2. A method of making a part for a bow sight as claimed in claim 1, wherein the desired part structure in step (a) is a body of the bow sight.

3. A method of making a part for a bow sight as claimed in claim 1, wherein the desired part structure in step (a) is a vertical positioning mechanism.

4. A method of making a part for a bow sight as claimed in claim 1, wherein the desired part structure in step (a) is a mounting bracket.

5. A method of making a part for a bow sight as claimed in any one of claims 2, 3, and 4, wherein the powdered metal is an alloy steel selected from the group consisting of 2% nickel iron, 50% nickel iron, 80% nickel iron, nickel-zinc ferrite alloy, and 3% silicon-iron alloy.

6. A method of making a part for a bow sight as claimed in any one of claims 2, 3, and 4, wherein the powdered metal is a tool steel.

7. A method of making a part for a bow sight as claimed in any one of claims 2, 3, and 4, wherein the powdered metal is selected from the group consisting of precipitation hardened stainless steel, martensitic stainless steel, ferritic stainless steel and austentic stainless steel.

8. A method of making a part for a bow sight as claimed in any one of claims 2, 3, and 4, wherein the powdered ceramic is selected from the group consisting of alumina, zirconia, and tungsten carbide.

9. The method according to claim 1, wherein the mold is approximately 10-20% larger than the end design, but has the geometric configuration of the final part.

10. The method according to claim 1, wherein material injected into the mold is sintered at an elevated temperature and pressure such that the part reaches a density of at least 90%.

11. A method of making a part for an archery bow arrow rest, the method comprising: (a) providing a mold being an inverse of a desired part structure; (b) injection molding powdered metal, ceramic or composite into the mold; and (c) removing from the mold a metal, ceramic or composite part for an archery bow arrow rest with a dimensional tolerance of 0.005 inch.

12. The method according to claim 11, wherein the mold is approximately 10-20% larger than the end design, but has the geometric configuration of the final part.

13. The method according to claim 11, wherein material injected into the mold is sintered at an elevated temperature and pressure such that the part reaches a density of at least 90%.

14. A method of making a part with a sight point for a bow sight, the method comprising: (a) providing a mold being an inverse of a desired part structure; (b) injection molding powdered metal, ceramic or composite into the mold; and (c) removing from the mold a metal, ceramic or composite part with a sight point with a dimensional tolerance of 0.005 inch.

15. The method according to claim 14, wherein the mold is approximately 10-20% larger than the end design, but has the geometric configuration of the final part.

16. The method according to claim 14, wherein material injected into the mold is sintered at an elevated temperature and pressure such that the part reaches a density of at least 90%.

* * * * *